US008926110B2

(12) United States Patent
Tsukitani et al.

(10) Patent No.: US 8,926,110 B2
(45) Date of Patent: Jan. 6, 2015

(54) LIGHTING DEVICE FOR ILLUMINATING MEAT

(71) Applicant: Panasonic Corporation, Osaka (JP)

(72) Inventors: Ayako Tsukitani, Kyoto (JP); Sayaka Yamaguchi, Osaka (JP); Takashi Saito, Osaka (JP)

(73) Assignee: Panasonic Coporation, Osaka (JP)

( * ) Notice: Subject to any disclaimer, the term of this patent is extended or adjusted under 35 U.S.C. 154(b) by 308 days.

(21) Appl. No.: 13/666,301

(22) Filed: Nov. 1, 2012

(65) Prior Publication Data

US 2013/0155647 A1 Jun. 20, 2013

(30) Foreign Application Priority Data

Dec. 16, 2011 (JP) ..... 2011-276182

(51) Int. Cl.
*F21V 9/08* (2006.01)
*F21V 9/16* (2006.01)

(52) U.S. Cl.
USPC ..... 362/84; 362/231; 362/293; 313/486; 313/501; 313/502

(58) Field of Classification Search
CPC ..... H05B 33/0857; F21V 9/08
USPC ..... 362/84, 231, 293; 313/485, 486, 501, 313/502, 503
See application file for complete search history.

(56) References Cited

U.S. PATENT DOCUMENTS

| | | | | |
|---|---|---|---|---|
| 5,684,359 | A * | 11/1997 | Yano et al. | 313/487 |
| 5,770,917 | A * | 6/1998 | Yano et al. | 313/486 |
| 8,132,939 | B2 * | 3/2012 | Platzer et al. | 362/293 |
| 2007/0167123 | A1 * | 7/2007 | Countz et al. | 452/134 |

FOREIGN PATENT DOCUMENTS

| | | |
|---|---|---|
| JP | 02-051844 | 2/1990 |
| JP | 03-235901 | 10/1991 |
| JP | 09-274891 | 10/1997 |
| JP | 10-055708 | 2/1998 |
| JP | 10-255722 | 9/1998 |
| JP | 10-312775 | 11/1998 |
| JP | 2004-327518 | 11/2004 |

OTHER PUBLICATIONS

Kenjiro Hashimoto et al., "New Method of Specifying Color-Rendering Properties of Light Sources Based on Feeling of Contrast", COLOR research and application, vol. 32, Issue 5, Oct. 2007, pp. 361-371.
China Office action, mail date is Jun. 6, 2014 along with an English language translation thereof.

* cited by examiner

*Primary Examiner* — Karabi Guharay
(74) *Attorney, Agent, or Firm* — Greenblum & Bernstein, P.L.C.

(57) ABSTRACT

A lighting unit emits light with an intensity in the wavelength from 430 to 510 nm that is maximum at 460 nm and minimum in the range from 490 to 500 nm, an intensity in the wavelength from 510 to 600 nm that is maximum in the range from 530 to 545 nm and minimum in the range from 570 to 580 nm, and an intensity in the wavelength of 600 nm or greater that is maximum in the range from 620 to 640. The lighting unit illuminates meat with light having a feeling of contrast index (FCI) of 135 to 145 and the illuminated meat has a metric hue angle from 54 to 56 and a color shift Duv from 0 to 5.

6 Claims, 6 Drawing Sheets

Fig.3

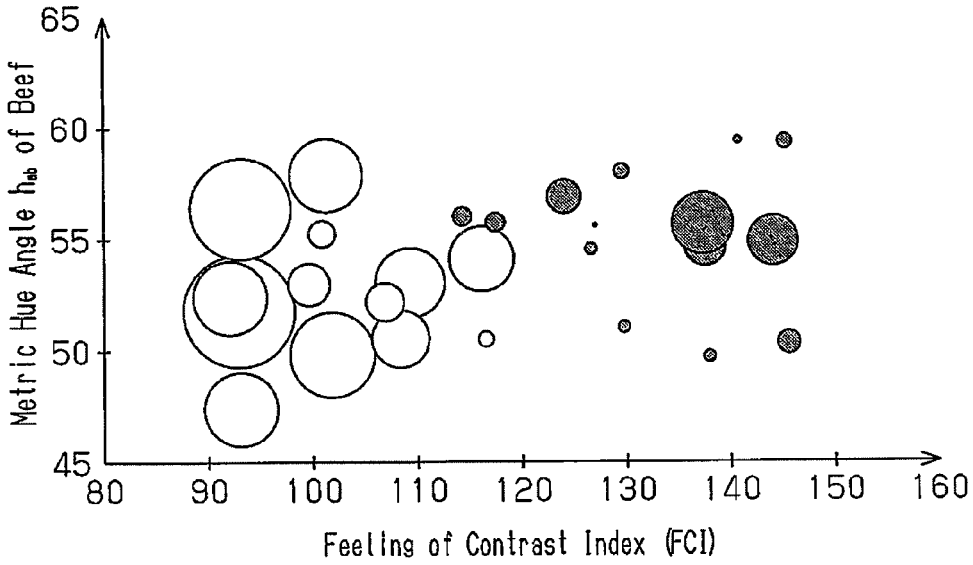

Fig.4

| | Lighting Unit Configuration Example | Correlated Color Temperature | Duv | FCI | Metric Hue Angle |
|---|---|---|---|---|---|
| A | High Color Rendering White LED<br>Neodymium Florescent Body | 2800 | 0.56 | 136 | 56 |
| B | Blue Gallium Nitride LED<br>Green Gallium Nitride LED<br>Red SCASN Fluorescent Body | 2691 | 4.98 | 145 | 55 |
| Comparative Example 1 | High Color Rendering LED | 2900 | 2.27 | 114 | 55 |
| Comparative Example 2 | High-Efficiency LED | 2894 | 2.06 | 94 | 57 |
| Comparative Example 3 | Three Wave Fluorescent Lamp | 3000 | −0.95 | 112 | 61 |

LIGHTING DEVICE FOR ILLUMINATING MEAT

CROSS-REFERENCE TO RELATED APPLICATIONS

This application is based upon and claims the benefit of priority from prior Japanese Patent Application No. 2011-276182, filed on Dec. 16, 2011, the entire contents of which are incorporated herein by reference.

BACKGROUND ART

The present invention relates to a lighting device.

Lighting devices for typical households are designed in consideration of a general color rendering index Ra to improve the color rendering properties and show true colors.

In contrast, lighting devices used in markets, for example, at fresh food sections, are not necessarily required to show the true color of an object (product). Rather, it is desirable that such lighting devices show products with an appealing (e.g., vivid) appearance to encourage the sales of the products.

Accordingly, for such fresh food sections, especially, meat sections, a lighting device that adds a red color to the illumination light to emphasize the redness of meat has been developed. Japanese Laid-Open Patent Publication No. 9-274891 describes an example of a lighting device that uses a fluorescent body including crimson in addition to red, green, and blue so that the redness of meat looks more vivid.

When using a lighting device of the prior art to illuminate meat with light, colors other than red, such as the color of the package containing meat or the color of the fat included in meat looks unnatural. In this manner, when simply illuminating meat with red light, colors other than red look unnatural and an observer would recognize that the vividness of the color of meat is rendered by light. This may adversely affect the sales of the product.

SUMMARY OF THE INVENTION

One aspect of the present invention is a lighting device including a lighting unit that illuminates meat with white light so that the light has a feeling of contrast index (FCI) of 135 to 145 and the meat illuminated with the light has a metric hue angle from 54 to 56 and a color shift Duv in the range from 0 to 5.

The present invention vividly renders the color of meat while preventing colors from appearing unnatural.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3 is a bubble chart showing the relationship (experiment results) of the feeling of contrast index and the metric hue angle;

FIG. 4 is a table showing the characteristics of conditions A and B and comparative examples 1 to 3;

DETAILED DESCRIPTION OF THE INVENTION

A lighting device 10 according to one embodiment of the present invention will now be described with reference to the drawings.

Figure 1:
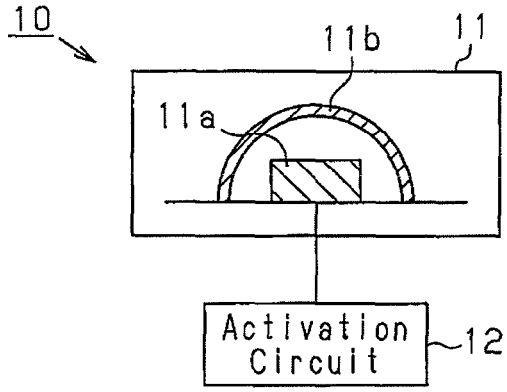
FIG. 1 is a schematic block diagram of a lighting device according to one embodiment of the present invention.

Referring to FIG. 1, the lighting device 10 includes a lighting unit 11, which emits light, and an activation circuit 12, which lights the lighting unit 11.

The lighting unit 11 includes an LED element 11*a*, which is electrically connected to the activation circuit 12, and a fluorescent body 11*b*, which covers the LED element 11*a*. A predetermined gap is formed between the LED element 11*a* and the fluorescent body 11*b*. When supplied with power from the activation circuit 12, the lighting unit 11 is lit in a generally white color.

The inventors of the present invention conducted the following experiment with the lighting device 10 to find conditions under which meat (beef in the present embodiment) had a preferable appearance.

Meat illuminated with reference light and meat illuminated with test light were compared by performing magnitude estimation.

A three band fluorescent lamp was used as the light source for the reference light. Thirty types of light sources having different feeling of contrast indexes and different metric hue angles for beef were used as the test light. The reference light and the test light had about the same color temperature. Further, the experiment used a device that disperses the light of a xenon lamp into a plurality of wavelengths with a diffraction grating, adjusts the light intensity of each wavelength, and combines all of the wavelengths before outputting the light.

The feeling of contrast index (FCI) can be expressed by the equation shown below. Light has a characteristic in which when the FCI is greater than 100, colors are vividly rendered such that the illuminated area appears bright.

$$FCI = \left[\frac{G_{LAB}(T)}{G_{LAB}(D65)}\right]^{1.5} \times 100 \qquad \text{Equation 1}$$

where $G_{LAB}(T)$ represents the color gamut area of a color combination sample for the four colors of red, blue, green, and yellow in LAB coordinates under the test light source, and $G_{LAB}(D65)$ represents the color gamut area of the four-color combination sample in LAB coordinates under the reference light source (6500 K).

Figure 2:
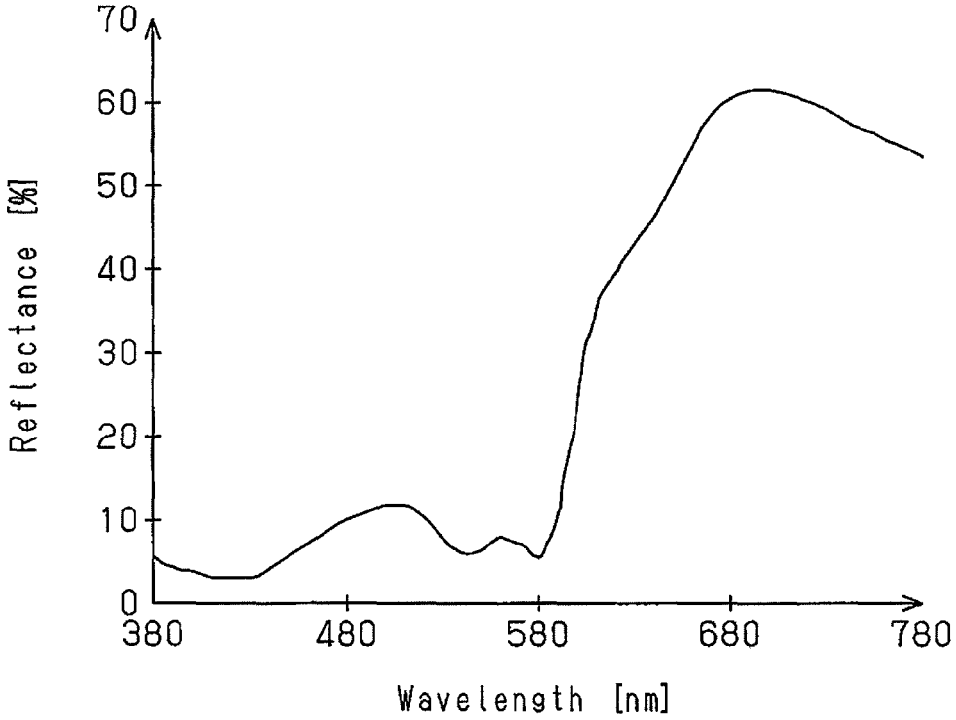
FIG. 2 is a graph showing the reflectance in correspondence with the wavelength of beef when illuminating beef with light emitted from a light source.

Further, the metric hue angle $h_{ab}$ can be expressed by the equation shown below. FIG. 2 shows the reflectance for each wavelength of the meat (beef) used in the following equation.

$$h_{ab} = \tan^{-1}\left(\frac{a^*}{b^*}\right) \quad \text{Equation 2}$$

$$\text{where } a^* = 500\left\{\left(\frac{X}{XO}\right)^{\frac{1}{3}} - \left(\frac{Y}{YO}\right)^{\frac{1}{3}}\right\},$$

$$b^* = 200\left\{\left(\frac{Y}{YO}\right)^{\frac{1}{3}} - \left(\frac{Z}{ZO}\right)^{\frac{1}{3}}\right\}.$$

In this equation, X, Y, and Z represent tristimulus values of meat under a light source, and XO, YO, and ZO represent tristimulus values of a complete dispersion reflection surface under a light source, where YO=100.

FIG. 3 is a bubble chart showing the experiment results. In FIG. 3, the horizontal axis represents the feeling of index (FCI) and the vertical axis represents the metric hue angle of meat. The size and pattern (white or shaded) of a bubble (circle) indicates an assessment value, that is, a geometric mean of eleven subjects. In this experiment, a relative assessment was given based on a state in which meat illuminated with the reference light was indicated as 100 points. The size of a bubble indicates the absolute value obtained when subtracting 100 from each assessment value. A white circle indicates a negative value obtained when subtracting 100 from each assessment value, and a shaded bubble indicates a positive value obtained when subtracting 100 from each assessment value.

As apparent from the experiment results shown in FIG. 3, the FCI is high when the color of meat (beef) is vivid. The evaluation values were especially high when the FCI was around 124 and from 135 to 145. The evaluation values were also high when the metric hue angle $h_{ab}$ was in the range from 50 to 60. As apparent from the bubbles at which the FCI is from 135 to 145, it is preferable that the metric hue angle $h_{ab}$ be centered around 55 in the range from 54 to 56.

In addition to the above experiment, the inventors of the present invention have observed the color shift Duv (distance from Planckian locus) at which the light from the lighting unit 11 becomes white light that does not appear unnatural. A light source that emits light of a color in which the Duv is within ±10 is normally classified as a white light source. However, in a market, lighting devices that provide light for the entire meat section and lighting devices that illuminate meat with light are used together with lighting devices that provides light to the surrounding of the meat section. Thus, for example, when the color of the light of lighting devices for meat are set so that the color shift Duv is negative and the color of the light of the surrounding lighting devices are set so that the color shift Duv is positive, an observer may relatively perceive redness in the color of the light from the lighting devices for meat. Thus, the color shift Duv is shifted from negative to positive (green) in the light from the lighting unit of the lighting device 10 in the present embodiment so that an observer does not perceive redness in the color of light.

Figure 9:
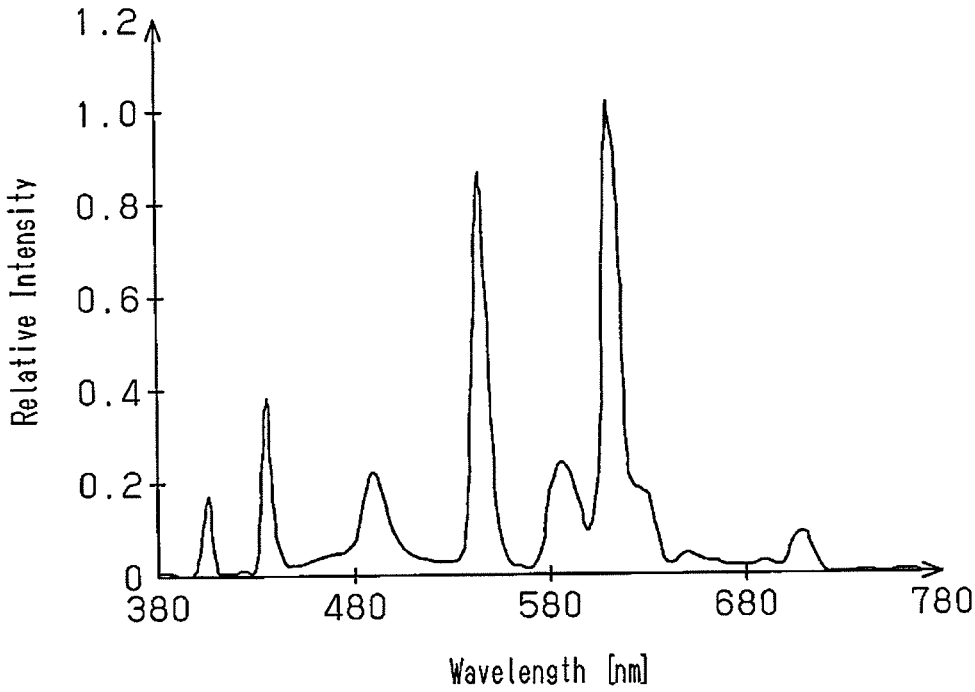
FIG. 9 is a spectrum characteristic diagram of a lighting device in comparative example 3.

When a three band fluorescent lamp is used in the lighting unit, the spectrum characteristics shown in FIG. 9 are obtained. Further, as shown in FIG. 4, unfavorable results are obtained in which the correlated color temperature is 3000 K, the color shift Duv is −0.95, the FCI is 112, and the metric hue angle $h_{ab}$ is 61.

Figure 5:
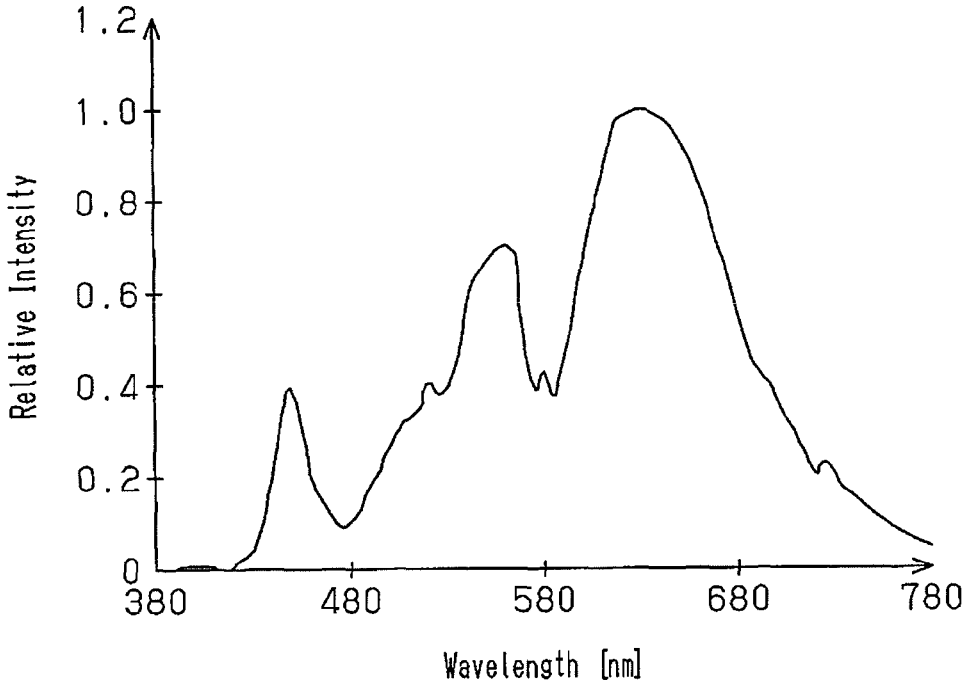
FIG. 5 is a spectrum characteristic diagram of the lighting device under condition A.

FIG. 5 shows one example of the spectrum characteristics (effect) of light emitted from the lighting unit 11 derived based on the experiment results and observations described above.

The LED element 11*a* of the lighting unit 11 is formed by a high color rendering white LED element, and the fluorescent body 11*b* of the lighting unit 11 is formed by a fluorescent body containing neodymium. In such a structure, the fluorescent body 11*b* absorbs light in the wavelength around 570 to 580 nm. Thus, as shown in FIG. 5, in the wavelength range from 510 to 600 nm, the lighting unit 11 emits light with an emission intensity that is locally maximum in the range from 530 to 545 nm and locally minimum in the range from 570 to 580 nm. When the wavelength is 600 nm or greater, the emission intensity is locally maximum in the range from 620 to 640 nm. The emission intensity of the LED element 11*a* is also locally maximum at the wavelength of approximately 460 nm.

Further, as shown in FIG. 5, the lighting unit 11 is formed to emit light so that when the maximum value of the emission intensity is 1 in the wavelength of 600 nm or greater, the maximum value of the emission intensity is 0.6 to 0.75 and the minimum value of the emission intensity is 0.1 to 0.4 in the wavelength range from 510 to 600 nm.

Differences between the lighting unit 11 and comparative examples will now be described. In comparative example 1, the lighting unit is formed by a high rendering LED element. In comparative example 2, the lighting unit is formed by a high-efficiency LED element. In comparative example 3, the lighting unit is formed by a three band fluorescent lamp.

Figure 7:
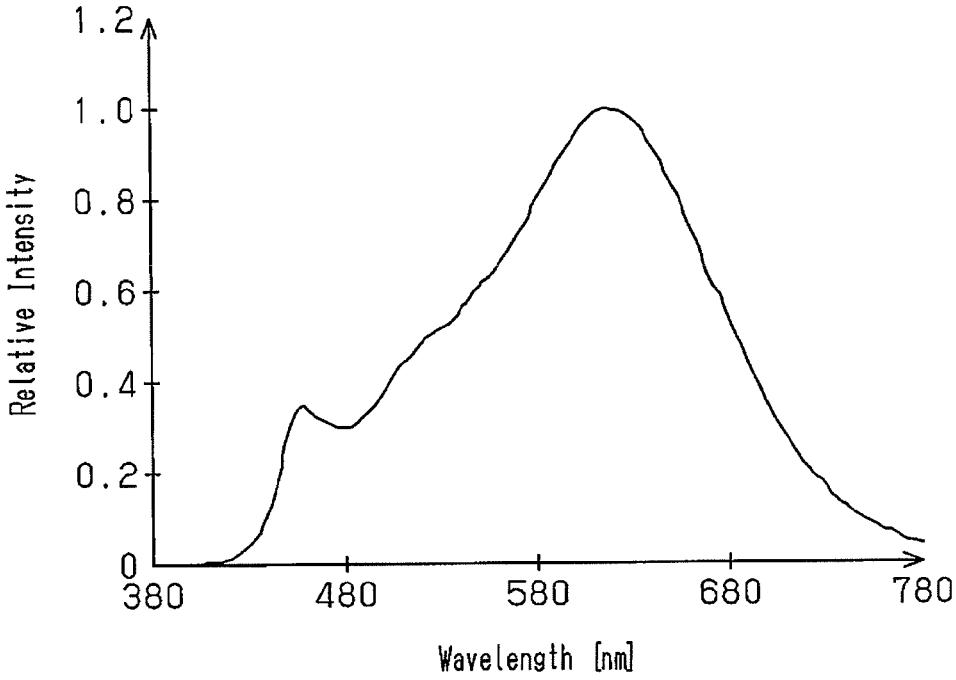
FIG. 7 is a spectrum characteristic diagram of a lighting device in comparative example 1.

FIG. 7 shows the spectrum of the light emitted from the lighting unit formed by the high rendering LED element. As shown in FIG. 7, the lighting unit emits light with an emission intensity in the wavelength range from 430 to 510 nm that is locally maximum at approximately 460 nm and an emission intensity in the wavelength of 600 nm or greater that is locally maximum in the range from 620 to 640 nm. However, the emission intensity does not have a maximum value (peak) in the wavelength range of 510 to 600 nm. When the lighting unit emits light having the spectrum characteristics of FIG. 7, unfavorable results are obtained as shown in FIG. 4 in which the correlated color temperature is 2900 K, the color shift Duv is 2.27, the FCI is 114, and the metric hue angle $h_{ab}$ is 56.

Figure 8:
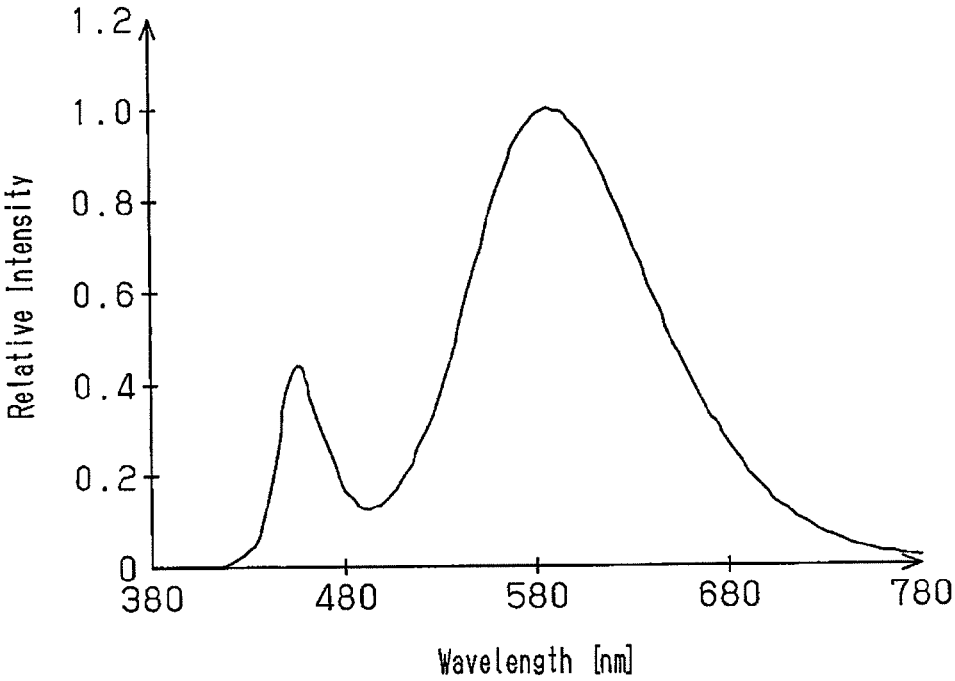
FIG. 8 is a spectrum characteristic diagram of a lighting device in comparative example 2.

FIG. 8 shows the spectrum of the light emitted from the lighting unit formed by the high-efficiency LED element. As shown in FIG. 8, the lighting unit emits light with an emission intensity that is locally maximum at approximately 460 nm in the wavelength range from 430 to 510 nm and locally maximum at about 600 nm in the wavelength range from 510 to 600 nm. The emission intensity does not have a maximum value (peak) in the wavelength of 600 nm or greater. When the lighting unit emits light having the spectrum characteristics of FIG. 8, unfavorable results are obtained as shown in FIG. 4 in which the correlated color temperature is 2894 K, the color shift Duv is 2.06, the FCI is 94, and the metric hue angle $h_{ab}$ is 57.

In contrast, by using a lighting unit that emits light having the spectrum characteristics shown in FIG. 5, the characteristics of condition "A" shown in FIG. 4 can be obtained. More specifically, the lighting unit 11 of the present embodiment is formed to obtain the characteristics in which the correlated color temperature is 2800 K, the color shift Duv is 0.56, the FCI is 136, and the metric hue angle $h_{ab}$ is 56.

The present embodiment has the advantages described below.

(1) The lighting unit 11 includes the LED element 11*a* and the fluorescent body 11*b*, which emits light when receiving light from the LED element 11*a*. The fluorescent body 11*b* contains neodymium and is formed to absorb light in the wavelength from 570 nm to 580 nm. Due to this structure, the lighting unit 11 emits light with an emission intensity in the wavelength range from 510 to 600 nm that is locally maximum in the range from 530 to 545 nm and locally minimum in the range from 570 to 580 nm. When the wavelength is 600 nm or greater, the emission intensity is locally maximum in the range from 620 to 640 nm. Further, due to the light of the LED element 11*a*, the lighting unit 11 emits light in which the emission intensity in the wavelength range from 430 to 510 nm is locally maximum at approximately 460 nm and locally minimum in the range from 490 to 500 nm. Further, the lighting unit 11 is formed to emit light so that when the maximum value of the emission intensity is 1 in the wavelength of 600 nm or greater, the maximum value of the emission intensity is 0.6 to 0.75 and the minimum value of the emission intensity is 0.1 to 0.4 in the wavelength range from 510 to 600 nm. Thus, the lighting unit 11 illuminates meat with light so that the light has a feeling of contrast index (FCI) of 135 to 145 and the meat has a metric hue angle $h_{ab}$ of 54 to 56 and a color shift Duv in the range of 0 to 5. As a result, the lighting unit 11 vividly renders the color of meat while preventing colors from appearing unnatural.

It should be apparent to those skilled in the art that the present invention may be embodied in many other specific forms without departing from the spirit or scope of the invention. Particularly, it should be understood that the present invention may be embodied in the following forms.

In the above embodiment, the lighting unit 11 is formed by the single LED element 11*a* and the fluorescent body 11*b*. However, the lighting unit 11 can have any structure as long as it emits light in which the FCI is from 135 to 145, the metric hue angle of the meat illuminated with the light is 54 to 56, and the color shift Duv is in the range of 0 to 5. One example of such a lighting unit will now be described.

Figure 10:
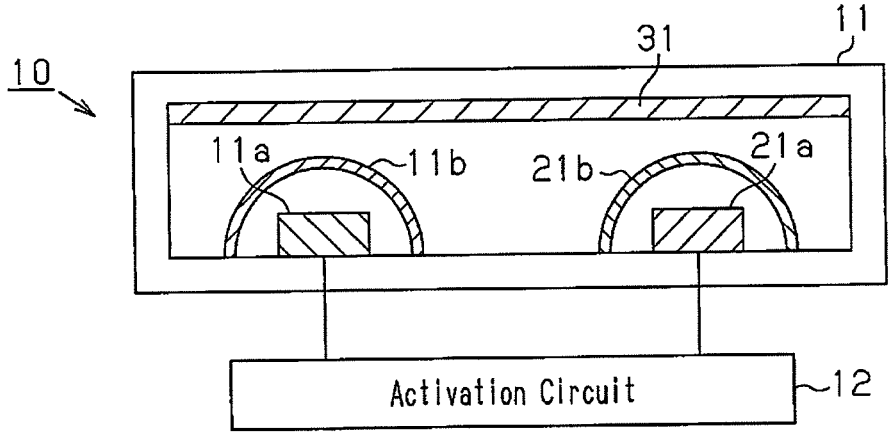
FIG. 10 is a schematic block diagram of a modified lighting device.

As shown in FIG. 10, the lighting unit 11 includes LED elements 11*a* and 21*a*, fluorescent bodies 11*b* and 21*b*, and a filter 31. The LED elements 11*a* and 21*a* emit light of which the emission intensity is locally maximum at about 460 nm, that is, the peak wavelength is about 460 nm. The fluorescent bodies 11*b* and 21*b* receive light from the LED elements 11*a* and 21*a* and emit light that is generally yellow. The filter 31 absorbs light in the wavelength range from 570 to 580 nm. The filter 31 covers the two LED elements 11*a* and 21*a* and the two fluorescent bodies 11*b* and 21*b*, which cover the LED elements 11*a* and 21*a*. For example, blue InGaN LED elements may be used as the LED elements, and a glass filter containing neodymium may be used as the filter 31.

Each of the LED elements 11*a* and 21*a* may be covered by a different filter 31.

Figure 11:
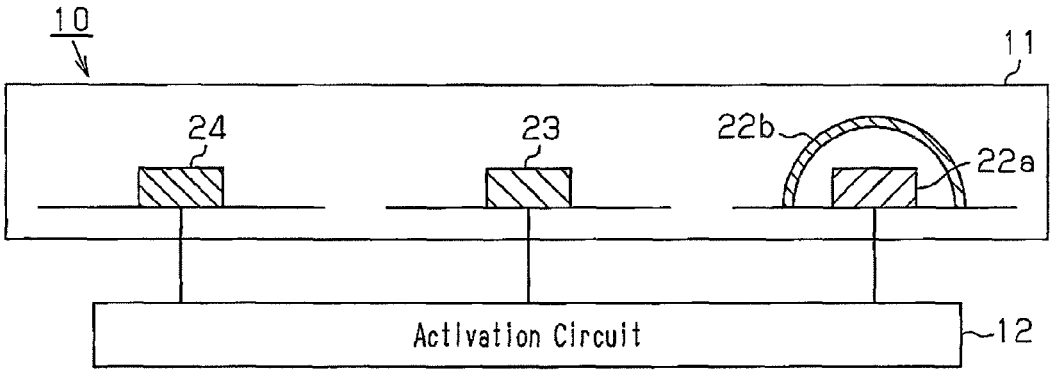
FIG. 11 is a schematic block diagram of a modified lighting device.

In an example shown in FIG. 11, the lighting unit 11 includes an LED element 22*a*, a fluorescent body 22*b*, and an LED element 23. The LED element 22*a* emits light having a peak wavelength at about 460 nm. The fluorescent body 22*b* covers the LED element 22*a*, receives light from the LED element 22*a*, and emits light that is generally red. The LED element 23 emits light having a peak wavelength in the range from 530 nm to 545 nm. The lighting unit 11 shown in FIG. 11 also includes an LED element 24 that emits light having a peak wavelength of about 460 nm.

Figure 12:
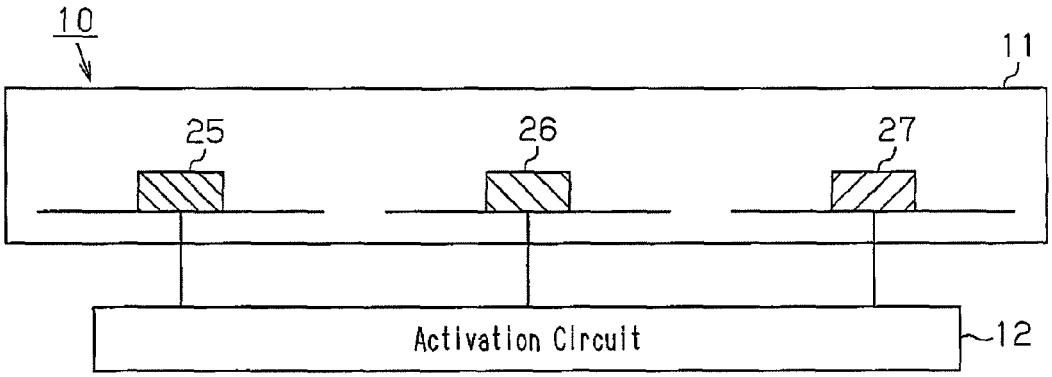
FIG. 12 is a schematic block diagram of a modified lighting device.

In an example shown in FIG. 12, the lighting unit 11 includes a first LED element 25, a second LED element 26, and a third LED element 27. The first LED element 25 emits light having a peak wavelength at about 460 nm. The second LED element 26 emits light having a peak wavelength in the range from 530 to 545 nm. The third LED element 27 emits light having a peak wavelength in the range from 620 to 640 nm. For example, a blue InGaN LED element may be used as the first LED element 25, a green InGaN LED element may be used as the second LED element, and a red AlInGaP LED element may be used as the LED element 27.

Figure 6:
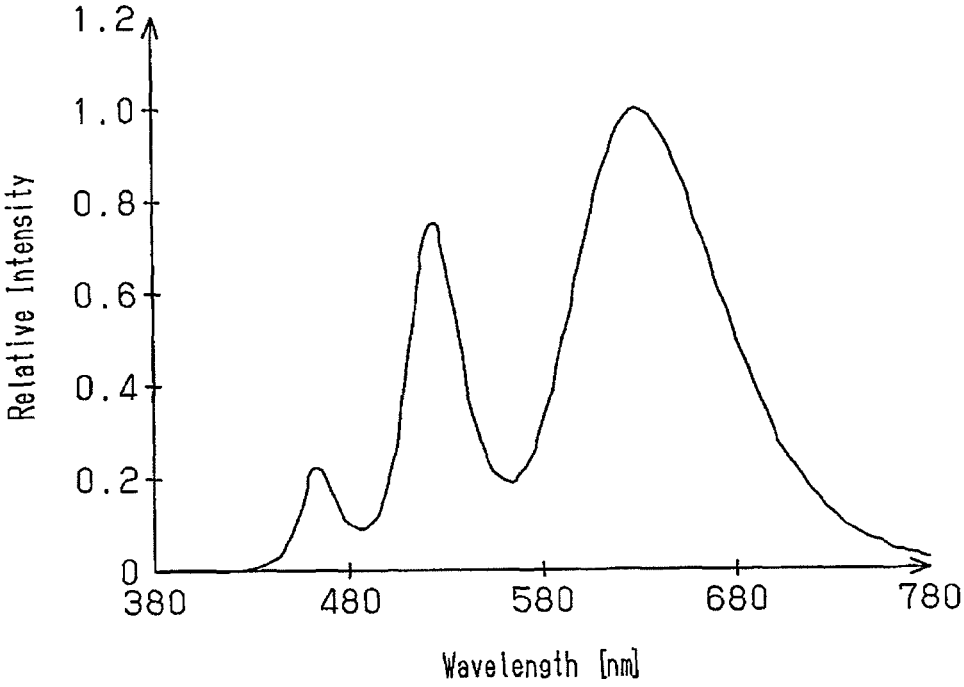
FIG. 6 is a spectrum characteristic diagram of the lighting device under condition B.

In the above embodiment, the lighting unit 11 is formed to emit light having the spectrum characteristics shown in FIG. 5. However, the lighting unit 11 is not limited in such a manner. For example, a lighting unit that emits light having the spectrum characteristics shown in FIG. 6 may be used. FIG. 6 shows the spectrum characteristics of the light emitted from the lighting unit that includes a blue gallium nitride LED element that serves as a first a LED element, a green gallium nitride LED element that serves as a second LED element, and a red SCASN fluorescent body. In this structure, the blue gallium nitride LED element emits light having a peak wavelength of about 460 nm, the green gallium nitride LED element emits light having a peak wavelength of 530 nm, and the red SCASN fluorescent body emits light having a peak wavelength of 630 nm. This structure obtains the characteristics indicated by "B" in FIG. 4. More specifically, the lighting unit is formed to illuminate meat with light so that the correlated color temperature is 2691 K, the color shift Duv is 4.98, the FCI is 145, and the metric hue angle $h_{ab}$ is 55. Thus, advantage (1) of the above embodiment can be obtained.

A gap is formed between the fluorescent body and the LED element in the lighting units 11 described above. However, the present invention is not limited in such a manner, and a fluorescent body may be applied to the LED element.

In the above embodiment, beef is exemplified as the meat. It is preferable that the lighting unit 11 have similar characteristics for other types of meat.

The present examples and embodiments are to be considered as illustrative and not restrictive, and the invention is not to be limited to the details given herein, but may be modified within the scope and equivalence of the appended claims.

What is claimed is:

1. A lighting device comprising a lighting unit that illuminates meat with white light so that the light has a feeling of contrast index of 135 to 145 and the meat illuminated with the light has a metric hue angle from 54 to 56 and a color shift Duv in the range from 0 to 5.

2. The lighting device according to claim 1, wherein the lighting unit is formed to emit white light with an emission intensity in the wavelength range from 430 to 510 nm that is locally maximum at 460 nm and locally minimum in the range from 490 to 500 nm, an emission intensity in the wavelength range from 510 to 600 nm that is locally maximum in the range from 530 to 545 nm and locally minimum in the range from 570 to 580 nm, and an emission intensity in the wavelength of 600 nm or greater that is locally maximum in the range from 620 to 640, and the lighting unit is formed to emit white light so that when the maximum value of the emission intensity is 1 in the wavelength of 600 nm or greater, the maximum value of the emission intensity is 0.6 to 0.75 and the minimum value of the emission intensity is 0.1 to 0.4 in the wavelength range from 510 to 600 nm.

3. The lighting device according to claim 2, wherein the lighting unit includes a first LED element that emits light of which the emission intensity is maximum at 460 nm, a second LED element that emits light of which the emission intensity is maximum in the range from 530 to 545 nm, and a third LED element that emits light of which the emission intensity is maximum in the range from 620 to 640 nm.

4. The lighting device according to claim 2, wherein the lighting unit includes an LED element and a filter that covers the LED element and absorbs light in the wavelength from 570 to 580 nm.

5. The lighting device according to claim 2, wherein the lighting unit includes an LED element and a fluorescent body that emits light when receiving light from the LED element, and the fluorescent body is formed to absorb light in the wavelength from 570 to 580 nm.

6. The lighting device according to claim 2, wherein the lighting unit includes a first LED element that emits light with an emission intensity that is maximum at 460 nm, a second LED element that emits light with an emission intensity that is maximum in the range from 530 to 545 nm, and a fluorescent body that emits light with an emission intensity that is maximum in the range from 620 to 640 nm.

* * * * *